US006854696B2

(12) United States Patent
Britigan

(10) Patent No.: US 6,854,696 B2
(45) Date of Patent: Feb. 15, 2005

(54) PORTABLE FOLDABLE FLORAL FIXTURE APPARATUS

(76) Inventor: Marcy Britigan, P.O. Box 1322, La Grange, IL (US) 60526

( * ) Notice: Subject to any disclaimer, the term of this patent is extended or adjusted under 35 U.S.C. 154(b) by 0 days.

(21) Appl. No.: 10/414,463

(22) Filed: Apr. 15, 2003

(65) Prior Publication Data

US 2004/0004048 A1 Jan. 8, 2004

Related U.S. Application Data

(60) Provisional application No. 60/373,707, filed on Apr. 18, 2002.

(51) Int. Cl.[7] ..... A47K 1/04

(52) U.S. Cl. ..... 248/129; 248/127; 248/27.8; 248/155.2; 108/92; 108/77; 211/85.23; 211/195; 280/639

(58) Field of Search ..... 280/38, 651, 79.11, 280/79.3, 30, 638, 639; 248/460, 165, 166, 439, 129, 27.8, 150, 155.2, 127; 211/85.23, 195, 149; 108/92, 77, 115

(56) References Cited

U.S. PATENT DOCUMENTS 4,066,023 A * 1/1978 Hughes ..... 108/50.01
4,446,796 A * 5/1984 Wilson et al. ..... 108/69
4,564,181 A * 1/1986 Gansel et al. ..... 269/88
4,572,081 A * 2/1986 Copeland ..... 108/17
4,740,010 A * 4/1988 Moskovitz ..... 280/641
4,750,432 A * 6/1988 McNamara et al. ..... 108/69
5,048,857 A * 9/1991 Stevens ..... 280/651
D399,681 S * 10/1998 Grosfillex ..... D6/480
6,349,962 B1 * 2/2002 Johanson ..... 280/651

* cited by examiner

*Primary Examiner*—Kimberly T. Wood
(74) *Attorney, Agent, or Firm*—William B. Ritchie

(57) ABSTRACT

A portable, foldable display apparatus that can be folded into a structure that is approximately one foot wide so that it can be easily stored. The apparatus is fitted with wheels so that the apparatus can be easily moved once it has been set up. An optional telescoping advertisement sign is provided. Multiple levels of display surfaces are provided. The apparatus can be used to display floral arrangements or other articles. The apparatus can be easily manufactured with display surfaces having different shapes to accommodate different merchandize.

8 Claims, 9 Drawing Sheets

PORTABLE FOLDABLE FLORAL FIXTURE APPARATUS

This application claims benefit of priority under 35 U.S.C. §119(e) to U.S. Provisional Application Ser. No. 60/373,707, filed on Apr. 18, 2002.

BACKGROUND OF THE INVENTION

1. Field of the Invention

The present invention generally relates to display apparatus, and, in particular, apparatus for use in stores for displaying floral arrangements or other merchandize that will encourage sales by allowing potential customers to easily view the goods in an attractive manner.

2. Description of the Related Art

Typical supermarkets as well as large discount chain having a variety of merchandise, frequently sell flower arrangements or other items that need to be displayed impulse buying. Since this type of merchandize is typically large and quite heavy, the usual cardboard display devices are not suitable. Structures having sufficient strength to hold vases or containers of flowers can be quite heavy and difficult to move once the need for them has passed.

Current devices for displaying flowers are typically fixed in size so that as the number of items decreases, the display may appear to a potential customer as being relatively empty with only the items that might have been considered as less desirable being left behind by prior shoppers. Again, this reduces the likelihood of sale of the remaining merchandize.

Building a permanent structure to display such items also is very difficult to store once the need for it has passed. While it can be taken down, the pieces then must be reassembled again for future use. Since the need for such structures may be intermittent yet substantially frequent, the cost associated with taking the display down and putting it up over and over could easily be quite substantial. Further, the frequent set-up and takedown will cause significant wear and tear on the display in a rather short period of time.

While a foldable table will meet the requirements of being easily stowable and quick to set-up, this solution lacks the attractiveness, such has as having multiple levels, to display the flower containers in the most attractive manor. Again, this diminishes the use of this approach.

A display apparatus, having multiple levels, that is easily foldable and stowable, is fitted with wheels, and can be outfitted with an optional telescoping sign, has a multiple display positions for displaying varying numbers of flower containers, is not found in the prior art.

SUMMARY OF THE PRESENT INVENTION

It is an aspect of the present invention to provide a portable foldable floral display apparatus that can be folded into a structure that is approximately one foot wide so that it can be easily stored.

It is another aspect of the present invention to provide a portable foldable floral display apparatus that is fitted with wheels so that the apparatus can be easily moved once it has been set up.

It is still another aspect of the present invention to provide a portable foldable floral display apparatus that has provision for attachment of a telescoping advertisement sign.

It is still another aspect of the present invention to provide a portable foldable floral display apparatus that can be manufactured in a number of display surface shapes to accommodate different merchandise.

Another aspect of the present invention is to provide a portable foldable floral display apparatus that has multi-level display surfaces so that a more attractive arrangement of the items that are to be sold can be arranged.

It is an aspect of the present invention to provide a portable foldable floral display apparatus that can be easily fabricated using readily available parts and construction materials.

Another aspect of the present invention is to provide a portable foldable floral display apparatus that can be partially collapsed so that the amount of display surface can be adjusted to correspond to the number of items remaining to be sold or to fit into a smaller space than is required for the apparatus when fully extended.

These aspects of the invention are not meant to be exclusive and other features, aspects, and advantages of the present invention will be readily apparent to those of ordinary skill in the art when read in conjunction with the appended claims and accompanying description.

DETAILED DESCRIPTION OF THE INVENTION

The invention is a portable display apparatus that is particularly well suited for displaying floral arrangement, however, other merchandise such as stuffed animals, dolls, plates, toys, and so on could also displayed. The apparatus can be set-up in different configurations so that more or less display surface area is provided by collapsing one or more of the display surfaces leaves. Further, once the display is no longer needed, the apparatus can be folded into an easily stowable size which can then be rolled away for future use. The apparatus can conveniently be fabricated from readily available materials so that the manufacturing cost is comparatively low.

The panels in the invention can be made from plywood, fiberboard, laminates or other materials used for display apparatus. The dimensions of apparatus 10 are not critical; however, to meet typical store requirements, the overall dimensions are preferably about 4' by 4', having a height about 30" from the floor to the top display surface. The collapsed dimensions are preferably less than one foot wide and four feet long, having a height that is about the same as in the opened position.

Figure 1:
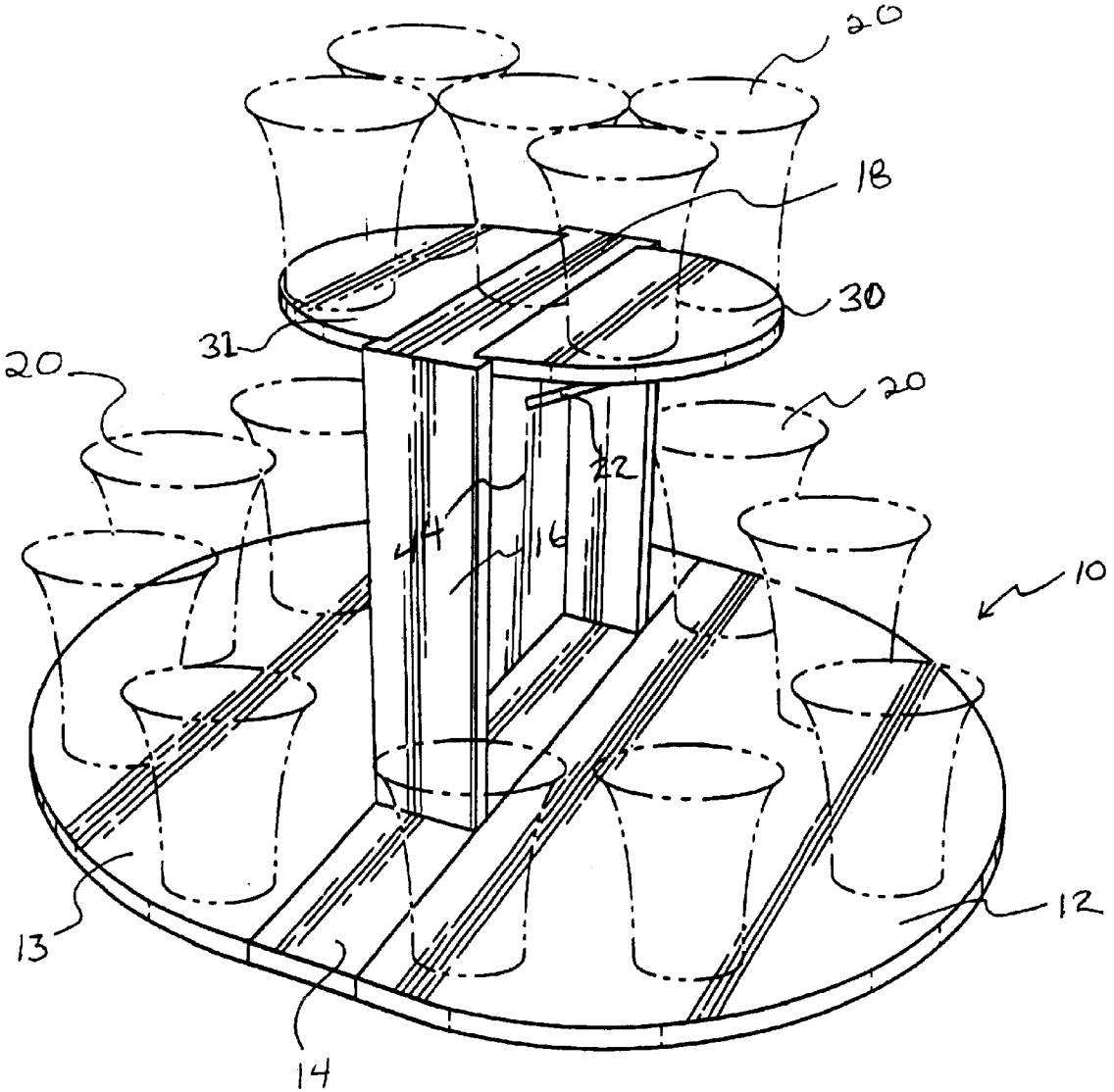
FIG. 1 is an isometric view of the apparatus fully opened with a plurality of flower containers resting thereon in accordance with the invention.

FIG. 1. is an isometric view of the display apparatus 10 fully opened with a plurality of flower containers 20 resting thereon in accordance with the invention. The left 13 and right 12 display surface leaves are shown as being shaped to form an oval when opened. However, other shapes of display leaves could also be used such as rectangular, hexagonal, pentagonal, round, or even free form.

Figure 9:
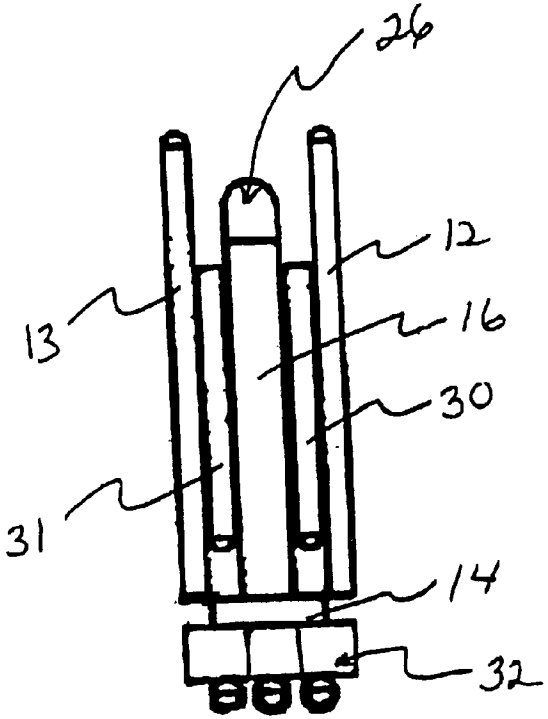
FIG. 9 is a view showing the apparatus fully collapsed, ready for storage.

Horizontal base separator 14 is used to support the top display surfaces 30, 31 via two vertical separators 16 disposed between horizontal separator 18. Vertical separators 16 and horizontal separator 18 provide a storage structure which used to attach the folded display surfaces into a collapsed configuration ready for storage as shown in FIG. 9.

Top display surfaces 30, 31 are held into position via pivotal brackets 22 which have one leg of the bracket 22 attached to the surface leaf and the other leg attached to separator panel 44. Each surface leaf 30, 31 has at least one bracket 22. This type of bracket is well known in the art and is used for card tables, utility tables, and the like which need to easily folded when not in use. The two legs are pivotally connected at their non-attachment ends so that the display surface can be collapsed by merely folding one leg towards the other. Other arrangements, also well known in the art, could also be used such as a hook and eye fastener, or other fasteners commonly used in table leaf arts where the hinged leaf forms an extension when raised into place.

As shown in FIG. 1, only two levels of collapsible leaves are provided, however, more than two can easily be accomplished. For example, a mid-section display leaf 85 could be inserted between top display leaf 30 and base display leaf 12. The mid-section display leaf would be held in position using another bracket 22 or other similar fastener mentioned above.

Figure 2:
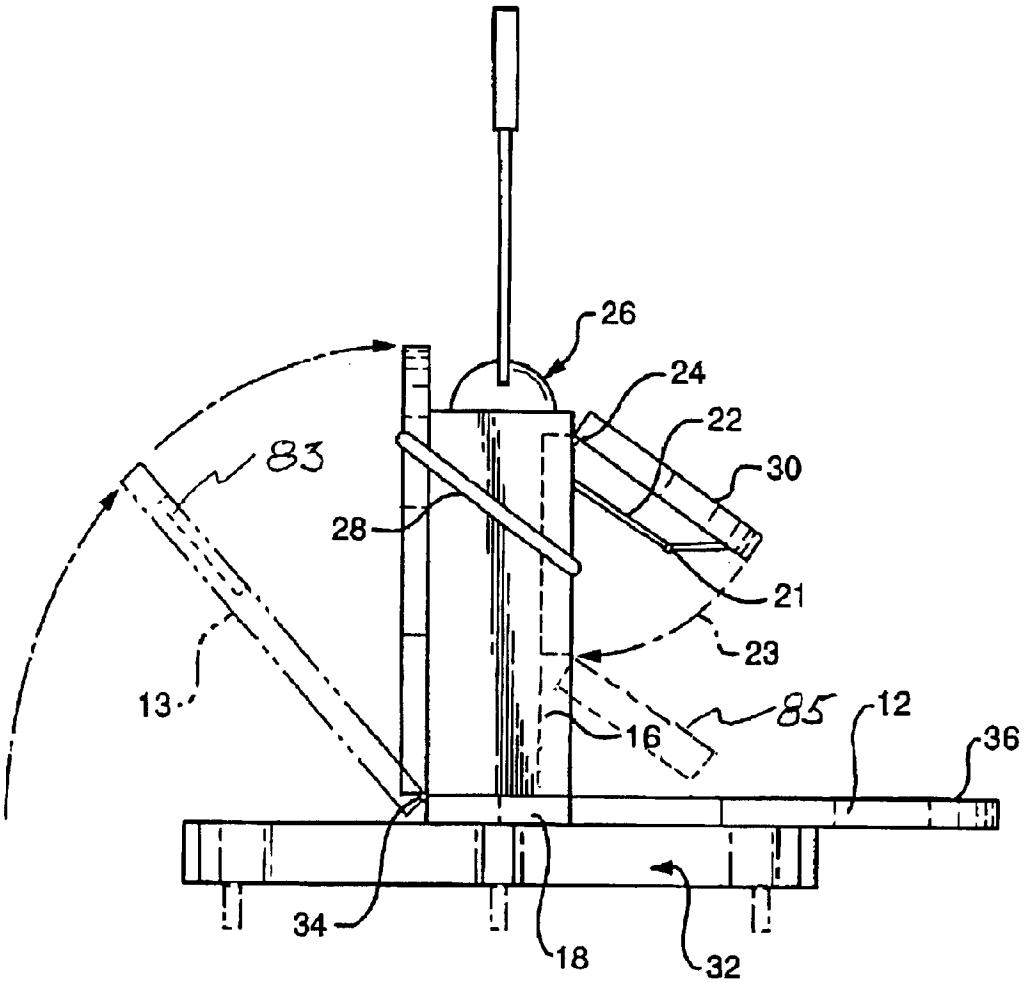
FIG. 2 is a left side view of the apparatus showing the left base display surface in the stowed position and the right top display surface in a partially closed position.

Referring now to FIG. 2, apparatus 10 is shown in the partially collapsed configuration. Display leaf 12 is supported by base support assembly 32 which is discussed below. Leaves 12, 13 are attached to horizontal base separator 18 via hinge 34. Hinge 34 is preferably a piano-hinge type, however, butt hinges or other type of hinge well known in the art could also be used.

Leaves 12, 13 optionally can be outfitted with detents 83 or openings 36 so that apparatus 10 is particularly adapted for use as a floral arrangement holder.

In the collapsed position, leaf 13 is placed vertically, resting against vertical separators 16. In order to ensure that leaf 13 is held in place, strap 28 is used. If both leaves 12, 13 are placed in the stowage position, then strap 28 can attach one to the other. Otherwise to merely hold one side up, as shown in FIG. 2, the snaps (not shown) on strap 28 can be attached to the leaf and the other to vertical separators 16. The type of snaps are not critical and any common snap such as used in clothing, boat canvas attachments, etc. can be used.

Top leaf 30 is shown in a partially folded position. Note that bracket 22 has one leg attached to leaf 30 and other leg attached to separator panel 44. To fold leaf 30, bracket 22 is released so that the legs are free to move around pivot 21 and leaf 30 drops down in the direction of arrow 23. Leaf 30 is attached to horizontal top separator 18 via hinge 24. Again, hinge 24 is preferably a piano-type of hinge but butt-hinges are other types well known in the art could also be utilized.

A sign assembly 26 is shown mounted on top of top separator 18 as will be discussed below.

Figure 3:
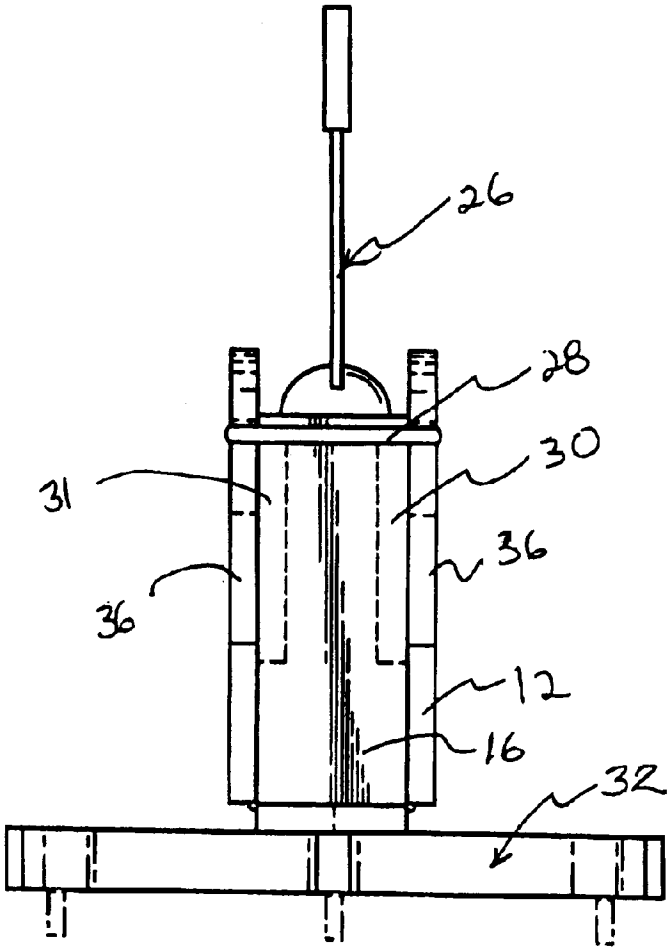
FIG. 3 is a left side view of the apparatus in the fully stowed position.

Referring to FIG. 3, apparatus 10 is shown with all leaves 12, 13, 30, 31 in the closed or collapsed configuration. The horizontal separator 18 has a pair of opposing cut-outs 81 (shown in FIG. 6) corresponding to the length and width of the pair of opposing top display surface leaves 30 and 31 such that when the pair of top opposing display surface leaves 30 and 31 are folded against said at least two vertical separators 16, the opposing top display surface leaves 30 and 31 are substantially flush with the two vertical separators 18. Note that base support assembly 32 is not attached to leaves 12, 13. Rather, leaves 12, 13 merely rest upon base support assembly 32.

Figure 4:
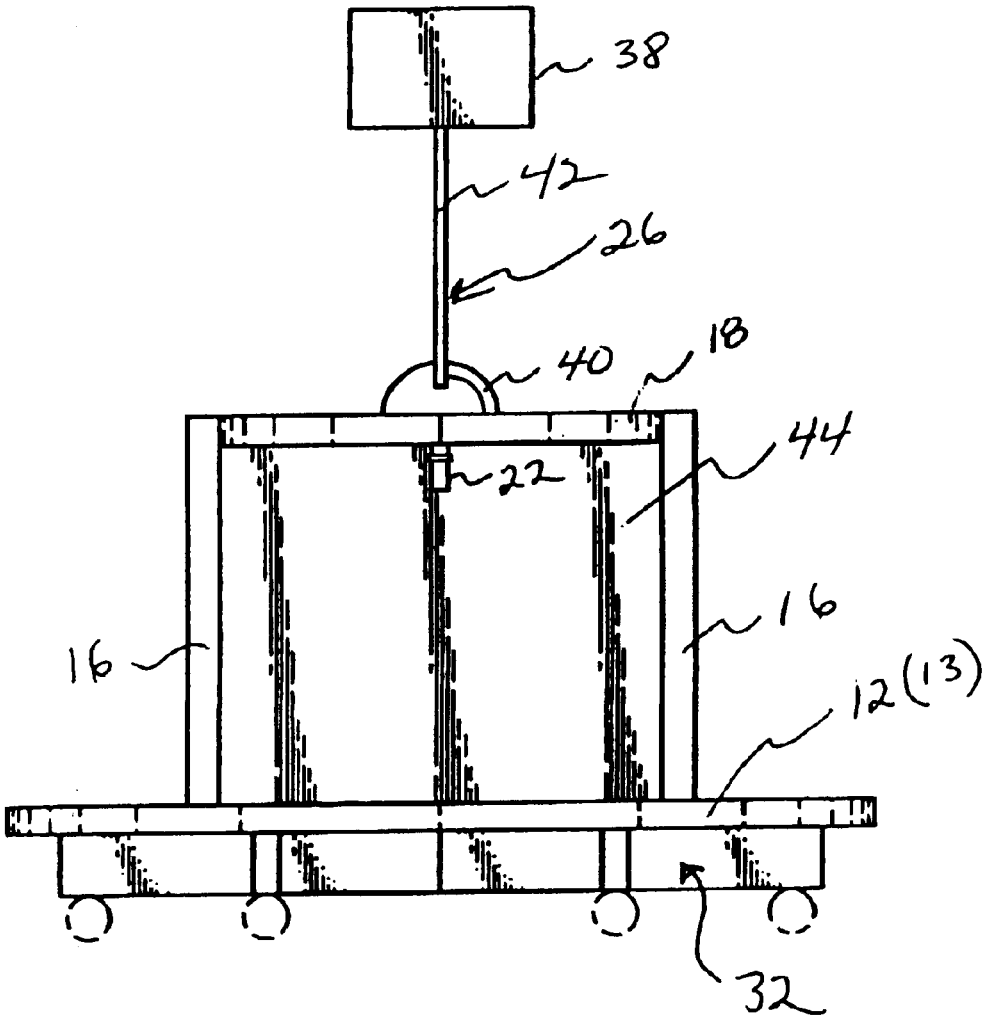
FIG. 4 is a left/right side view of the apparatus in the fully opened position with the optional sign assembly attached.

As shown in FIG. 4, apparatus 10 is a left or right side view showing that the invention is bilaterally symmetrical. Sign assembly 26 includes base 40 which releasably attaches to horizontal top separator 18. Positioned within base 40 is telescopic support 42 with sign 38 at the top. Sign assembly 28 provides a convenient method of permitting the store to advertising the price or other pertinent information about the goods being displayed for sale.

Figure 5:
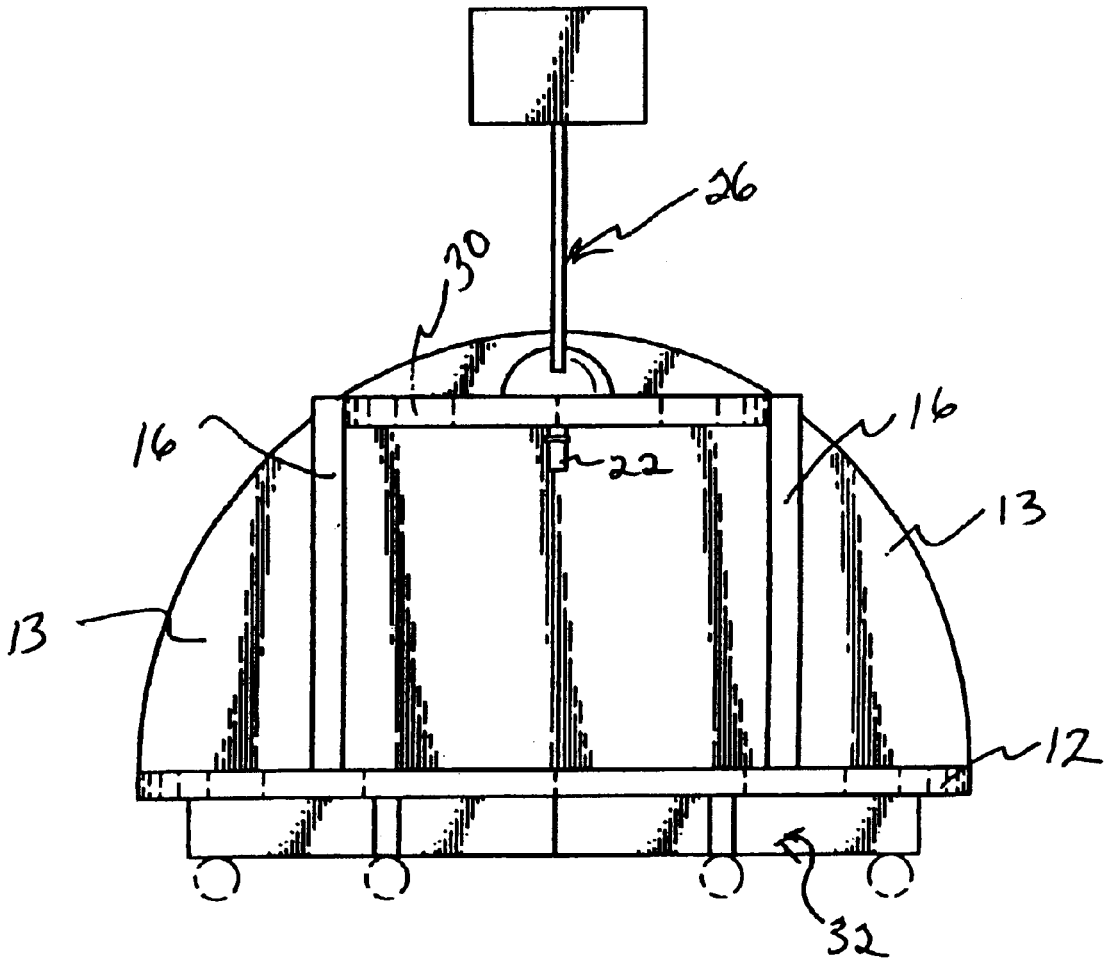
FIG. 5 is a front view of the apparatus with the left base display in the stowed position.

FIG. 5 is similar to FIG. 4 and differs only in that top leaf 31 and right leaf 13 have been collapsed so that apparatus 10 now requires only half as much floor space. While leaf 30 is shown opened, it could be collapsed as well to permit the display of larger items, such as tall plants, etc.

Figure 6:
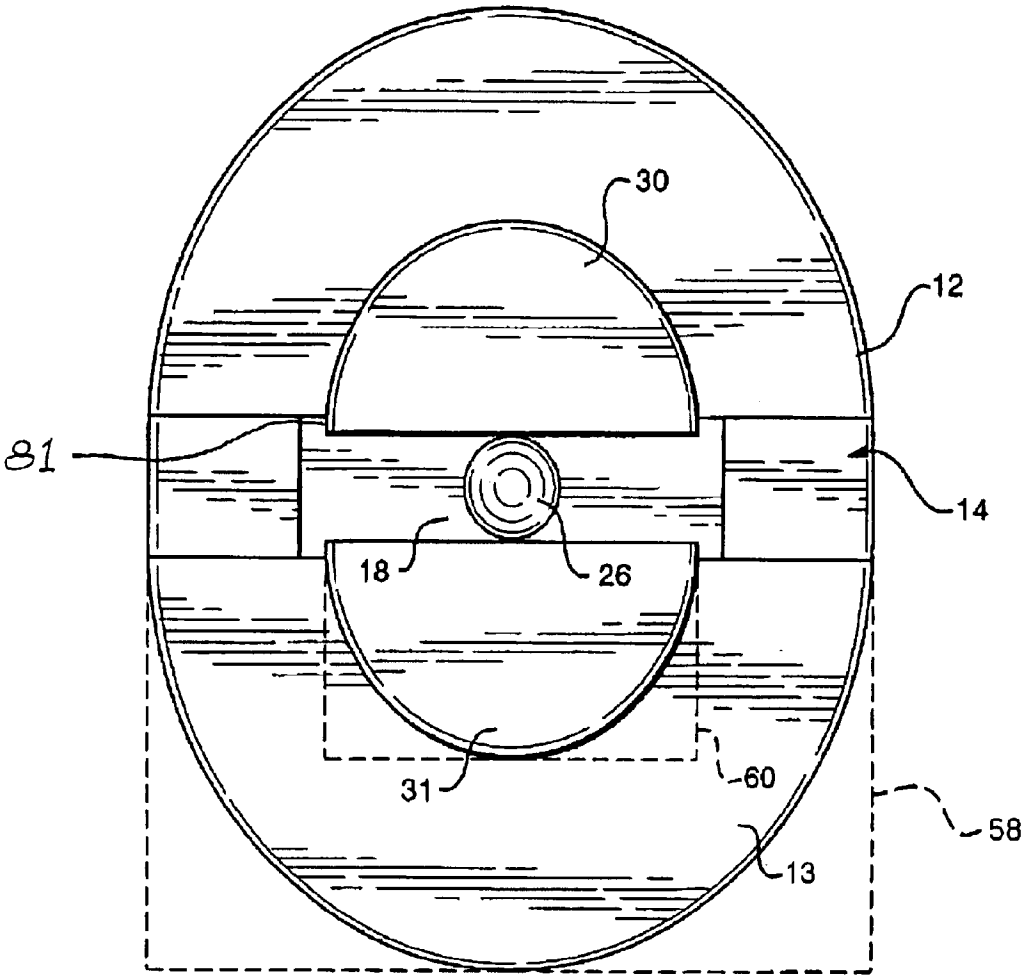
FIG. 6 is a top view.

FIG. 6 is a top view of apparatus 10. As noted above, the particular shape of leafs 12, 13 and 30, 31 enable apparatus 10 to have an oval configuration. However, one or both of leaves 12 and 13 could be shaped as shown with dotted line 58 as well as top leaves 30, 31 could be configured as noted by dotted line 60, thus providing a rectangular shape. In this manner, leafs could be designed to have a number of shapes as previously noted as will be understood by those of ordinary skill in this art.

Figure 7:
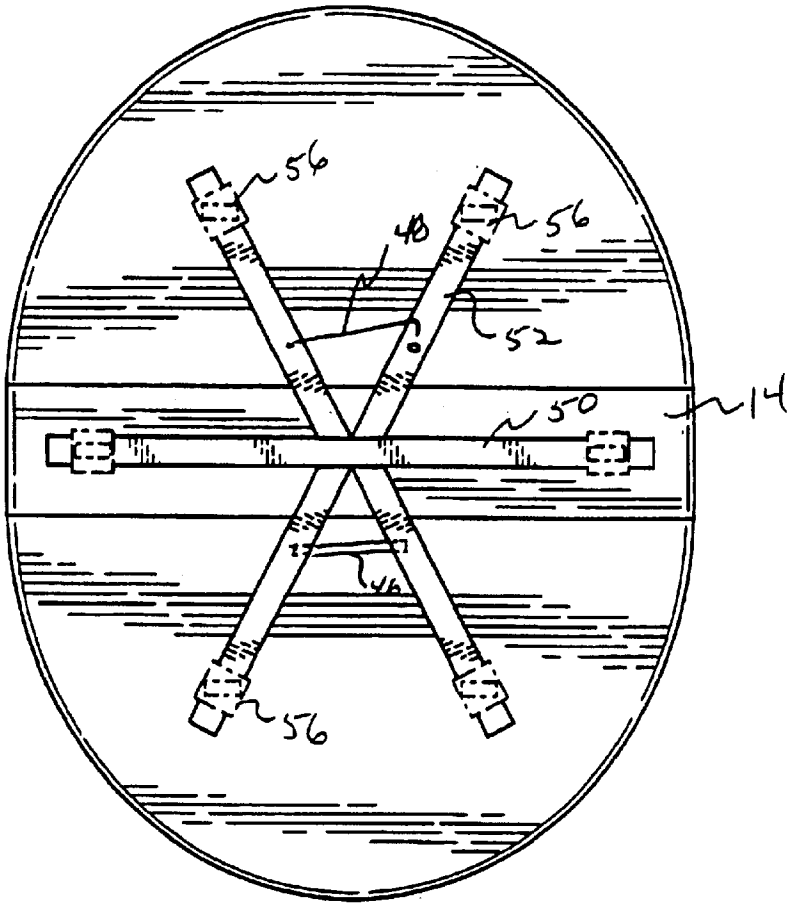
FIG. 7 is a bottom view showing the base support assembly.
Figure 8:
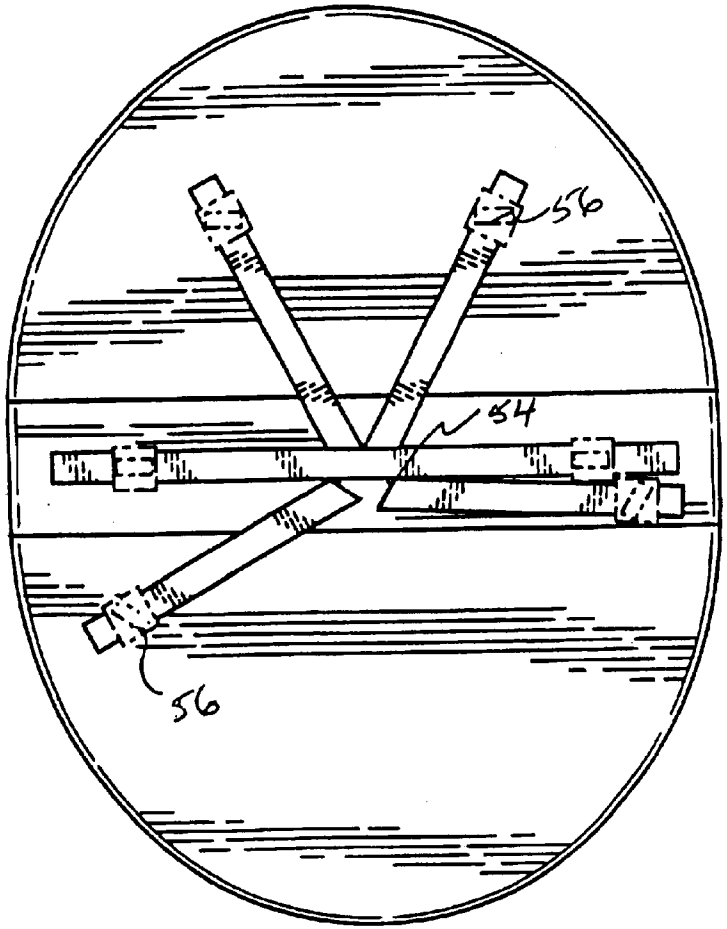
FIG. 8 is a bottom view showing the base support assembly in a partially position.

Referring now to FIGS. 7, 8, base support assembly 32 is shown in detail. Base separator wheel support member 50 is rigidly attached to the underside of horizontal base separator 14. Member 50 can be attached to separator 14 using a variety of techniques well known in the art such as screws, nails, glue, bolts, etc. Member 50 is preferably fitted with caster wheels 56 at the opposing ends. The selection of caster wheels 56 is not critical but should enable a user to be able to move apparatus 10 even when fully loaded. Preferably, at least one or more of the caster wheels 56 should be a locking type, again well known in the art, so that the wheels can be locked to prevent customers or children from moving apparatus 10 once it has been set in place.

Extending from each side of member 50 are base display surface support members 52, a pair extending from each side of member 50 as shown. Members 52 are attached to member 50 using hinges 54. Hinges 54 are preferably butt-type but again other hinge types well known in the art could be substituted. Note that members 52 properly positioned so that respective base display leaves are properly supported by locking members 52 together using a u-shaped pin 46 such that each end of the "U" drops into a hole on the top of its respective member 52 or, in the alternative, hook and eye fastener 48 drops into holes located on the top of hook and eye fastener 48 which would be attached to the bottom of each member 52. Again, other easily releasable fasteners well known in the art could be used.

FIG. 9 shows the invention in the fully collapsed state, ready for storage. As noted above, base support assembly 32 is preferably permanently attached. However, member 50 could be attached to horizontal separator 14 using bolts and wing nuts, if it was desired to have apparatus 10 to have even a smaller storage "footprint".

Although the present invention has been described with reference to certain preferred embodiments thereof, other versions are readily apparent to those of ordinary skill in the art. Therefore, the spirit and scope of the claims is not limited to the description of the preferred embodiments contained herein.

What is claimed is:

1. A display apparatus comprising:

a horizontal base separator having a left and right edge; and a base separator wheel support member rigidly attached to said horizontal base separator;

a pair of display surface support members foldably extending from said base separator wheel support member; and a left display leaf hinged to the left edge of said horizontal base separator; and a right display leaf hinged to the right edge of said horizontal base separator; and at least two vertical separators attached to said horizontal base separator; and a top horizontal separator attached to said at least two vertical separators; and a pair of opposing top display surface leaves pivotally attached to said top horizontal separator;

such that said display apparatus is fully collapsed by first folding said pair of opposing top display surface leaves adjacent to said at least two vertical separators, secondly folding said left and right display leaves against said at least two vertical separators, and lastly folding said pair of display surface support members against said base separator wheel support member; and such that when said display apparatus is fully open, a plurality of articles may be displayed on said display apparatus.

2. The display apparatus of claim 1 wherein said top horizontal separator further comprises a pair of opposing cut-outs corresponding to the length and width of said pair of opposing top display surfaces such that when said pair of opposing display surface are folded against said at least two vertical separators, said opposing top display surfaces are substantially flush with said at least two vertical separators.

3. The display apparatus of claim 1 further comprising a pair of mid-section display leaves attached to said at least vertical separators and positioned between said top display leaves and said left and right display leaves.

4. The display apparatus of claim 1 wherein said right and left display leaves further comprise a plurality of detents to position merchandize.

5. The display apparatus of claim 1 wherein said right and left display leaves further comprise a plurality of openings adapted to hold merchandise.

6. The display apparatus of claim 1 further comprising a sign assembly mounted onto said top horizontal separator.

7. The display apparatus of claim 1 wherein said top display leaves further comprise a plurality of detents to position merchandise.

8. The display apparatus of claim 1 wherein said top display leaves further comprise a plurality of openings adapted to hold merchandise.

* * * * *